US005186035A

United States Patent [19]

Tuck

[11] Patent Number: 5,186,035

[45] Date of Patent: Feb. 16, 1993

[54] TUBE LOADING SLEEVE FOR PILGER MILL

[75] Inventor: Paul B. Tuck, Wilmington, N.C.

[73] Assignee: General Electric Company, San Jose, Calif.

[21] Appl. No.: 836,682

[22] Filed: Feb. 18, 1992

[51] Int. Cl.[5] ..... B21B 21/00; B21B 25/00

[52] U.S. Cl. ..... 72/208; 72/370

[58] Field of Search ..... 72/96, 208, 209, 214, 72/370

[56] References Cited

U.S. PATENT DOCUMENTS

| | | | |
|---|---|---|---|
| 2,365,268 | 12/1944 | Herter, Jr. | 66/170 |
| 3,083,494 | 4/1963 | Lindenbaum | 45/68 |
| 3,785,418 | 1/1974 | Hennig et al. | 150/52 R |
| 4,158,407 | 6/1979 | Rest | 206/318 |
| 4,233,834 | 11/1980 | Matinlassi | 72/208 |
| 4,930,328 | 6/1990 | Duerring | 72/208 |
| 4,956,988 | 9/1990 | Fischer et al. | 72/208 |
| 5,005,755 | 4/1991 | Takahashi et al. | 72/208 |

*Primary Examiner*—Lowell A. Larson
*Assistant Examiner*—Thomas C. Schoeffler
*Attorney, Agent, or Firm*—Harry C. Burgess

[57] ABSTRACT

To minimize the incurrence of defects in the inner surface of a nuclear fuel cladding tube produced in a pilger mill from a Zircaloy tube, a loading sleeve is inserted onto the pilgering mandrel assembly in close fitting relation, and the Zircaloy tube is then inserted onto the sleeve in close fitting relation. The sleeve, formed of ABS plastic, is then withdrawn, leaving the Zircaloy tube loaded on the mandrel assembly preparatory to reducing the Zircaloy tube down to cladding tube dimensions in the pilger mill.

11 Claims, 1 Drawing Sheet

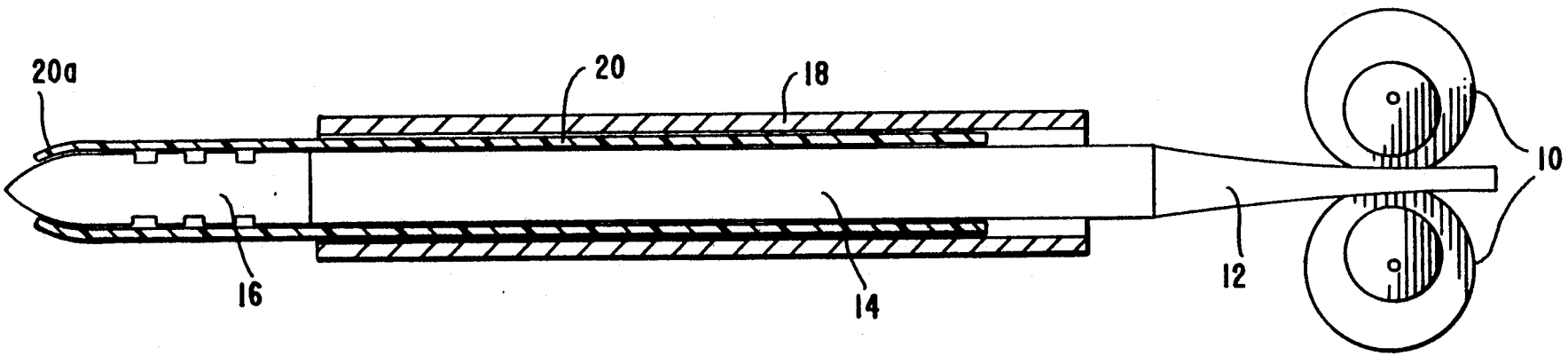
10
12
14
16
18
20
20a

TUBE LOADING SLEEVE FOR PILGER MILL

The present invention relates to the manufacture of nuclear fuel rods and particularly to the production of the Zircaloy cladding or tubing utilized in nuclear fuel rods.

BACKGROUND OF THE INVENTION

In the production of Zircaloy cladding tubes for nuclear fuel rods, Zircaloy tube stock having an outer diameter (OD) of, for example, 2.5 inches, is cold worked by numerous passes in a pilger mill down to an OD on the order of 0.5 inches with a wall thickness of, for example, 0.025 inches. Of course, these dimensions will vary depending on the particular fuel rod design in production. The finished tube must meet strict dimensional specifications and be essentially defect-free. Of particular concern are defects on the inner surface of a finished tube due to the presence of an extremely thin pure zirconium liner. If this previously applied uniform liner is disrupted during the pilgering process, any buildups of the soft zirconium are worked into the tube wall cross section, resulting in rejectable defects which are discovered during ultrasonic inspection. These defective tubes must then be scrapped, resulting in lost labor, material and throughput.

SUMMARY OF THE INVENTION

It is accordingly an objective of the present invention to minimize the instances of defects on the inner surface of Zircaloy tubing incurred during pilger milling of a tube down to nuclear fuel cladding dimensions. In achieving this objective, Applicant has discovered that the inner surface defects are largely created during the tube loading stage when the Zircaloy tube stock is inserted on the mandrel rod assembly preparatory to the final pilgering pass. Any metal burrs on the surface of the mandrel rod assembly will inflict scratches in the soft zirconium liner as the tube inner surface slides over the mandrel assembly during loading. The burrs disrupt the liner uniformity and cause a buildup of zirconium at the tail ends of scratches inflicted by the burrs. The zirconium buildups are then worked into the tube wall during the pilgering process and result in defects destroying the efficacy of the finished tube as nuclear fuel cladding.

To solve this defect problem in accordance with the present invention, a sleeve is inserted over the mandrel rod assembly prior to loading the Zircaloy tube on the mandrel. The sleeve, formed of a suitable material such as acrylonitrile butadiene styrene (ABS) plastic, serves as a protective barrier between the mandrel surface and the inner surface of the Zircaloy tube. The smooth outer surface of the sleeve preserves the zirconium liner integrity as the Zircaloy tube slides over the sleeve incident to loading, and as the sleeve is subsequently removed preparatory to pilgering, with the result that inner surface defects in the finished cladding tubes are dramatically reduced.

BRIEF DESCRIPTION OF THE DRAWING

For a full understanding of the nature and objective of the present invention, reference may be had to the accompanying drawing, in which the sole figure is a longitudinal sectional view of a pilger mill mandrel assembly adapted with the loading sleeve of the present invention.

DETAILED DESCRIPTION

Referring to the drawing, a pair of counter rotating forming rolls or dies 10 of a pilger mill are mounted by conventional means (not shown) for oscillatory axial motion relative to a tapered mandrel 12 of a mandrel assembly. The mandrel is affixed to one end of a mandrel rod 14, whose other end is terminated by a tail piece 16. The mandrel assembly, which may be in excess of thirty feet in length, is cantilever mounted by a conventional chuck (not shown), which grips the tail piece. A Zircaloy tube stock 18 is loaded onto the mandrel assembly and is gripped by a conventional holder (not shown), which acts to pass the Zircaloy tube through the dies in increments of axial and rotational motion.

In accordance with the present invention, to protect the delicate zirconium liner on the inner surface of the Zircaloy tube during the loading step, an elongated loading sleeve 20 is first inserted onto the mandrel assembly in close fitting relation. Preferably, one end 20*a* of the sleeve is cone-shaped to conform with the conical termination of tail piece 16 to establish a rightward-most position of the sleeve on the mandrel assembly. The Zircaloy tube is then inserted onto the mandrel assembly over the sleeve in close fitting relation. The inner surface of the tube thus slides over the outer surface of the sleeve as the tube is inserted from left to right into a loaded position. Sleeve 20 is then slid out leftward from between the tube and the mandrel assembly. Once the sleeve is removed, the tail piece of the mandrel assembly is gripped by the mandrel chuck, and the Zircaloy tube is gripped by its holder to prepare the pilger mill for operation to reduce the Zircaloy tube down to nuclear fuel cladding tube dimensions.

Sleeve 20 must of course possess a smooth outer surface to avoid scratching the zirconium inner liner during relative sliding motion incident to loading the tube and removal of the sleeve. To accommodate handling, the sleeve should also have sufficient strength to remain rigid despite its considerable length, e.g., fifteen feet, and thin wall thickness, e.g., on the order of 0.020 inches. Acrylonitrile butadiene styrene (ABS) plastic has been found to be an eminently suitable sleeve material. However, other high strength plastics having the requisite structural attributes are also applicable as sleeve materials. The inner and outer diameters of the sleeve are of course determined by the cladding tube size to be produced. However, to facilitate application and removal, the sleeve should have an inner diameter in the range of 5–10 mils greater than the outer diameter of the mandrel rod and an outer diameter in the same 5–10 mil range less than the inner diameter of the Zircaloy tube.

Having described the invention, what is claimed as new and desired to secure by Letter Patent is:

1. In a pilger mill for reducing Zircaloy tube stock down to nuclear fuel cladding tube dimensions, an elongated loading sleeve having an inner diameter such as to permit insertion to said sleeve over a mandrel assembly of the pilger mill in close fitting relation and an outer diameter such as to permit insertion of a Zircaloy tube or said sleeve in close fitting relation, said sleeve providing a barrier protecting an inner surface of the Zircaloy tube during loading thereof onto the mandrel assembly preparatory to pilgering, said sleeve then being removed prior to reduction of the loaded Zircaloy tube down to cladding tube dimensions.

2. The loading sleeve defined in claim 1 having a wall thickness on the order of 0.020 inches.

3. The loading sleeve defined n claim 1, wherein a terminal portion of said sleeve has a reduced diameter for engagement with a termination of the mandrel assembly to establish a loading position for said sleeve.

4. The loading sleeve defined in claim 1 wherein said sleeve is formed of a high strength plastic.

5. The loading defined in claim 4, wherein said sleeve is formed of ABS plastic.

6. The loading sleeve defined in claim 5 having a wall thickness on the order of 0.020 inches.

7. The loading sleeve defined in claim 6, wherein a terminal portion of said sleeve has a reduced diameter for engagement with a termination of the mandrel assembly to establish a loading position for said sleeve.

8. A method for loading a Zircaloy tube onto a mandrel of a pilger mill preparatory to reducing the Zircaloy tube down to nuclear fuel cladding tube dimensions, said method comprising the steps of A. inserting an elongated sleeve onto the mandrel;

B. inserting a Zircaloy tube onto the sleeve; and

C. removing the sleeve, leaving the Zircaloy tube loaded on the mandrel for reduction by forming rolls of the pilger mill.

9. The method of claim 8, wherein said sleeve is comprised of a high strength plastic.

10. The method defined in claim 9, wherein said sleeve is comprised of ABS plastic.

11. The method defined in claim 10, wherein said sleeve has a wall thickness on the order of 0.020 inches.

* * * * *